US006064853A

United States Patent [19]

Embry et al.

[11] Patent Number: 6,064,853

[45] Date of Patent: May 16, 2000

[54] APPARATUS FOR CURLING MATERIALS

[75] Inventors: Kerry L. Embry, Lexington; Scott S. Williams, Versailles, both of Ky.

[73] Assignee: Lexmark International, Inc., Lexington, Ky.

[21] Appl. No.: 09/447,689

[22] Filed: Nov. 23, 1999

Related U.S. Application Data

[63] Continuation-in-part of application No. 09/393,570, Sep. 10, 1999.

[51] Int. Cl.[7] ..... G03G 15/00

[52] U.S. Cl. ..... 399/406; 162/271; 493/459

[58] Field of Search ..... 399/406, 390; 493/459; 271/161, 188, 209; 162/197, 270, 271

[56] References Cited

U.S. PATENT DOCUMENTS

| | | | |
|---|---|---|---|
| 2,012,953 | 9/1935 | Brunner et al. . | |
| 2,531,619 | 11/1950 | Gonia . | |
| 4,505,695 | 3/1985 | Billings . | |
| 4,539,072 | 9/1985 | Frye et al. . | |
| 4,924,275 | 5/1990 | Nelson . | |
| 5,009,749 | 4/1991 | Cederholm et al. . | |
| 5,017,970 | 5/1991 | Sakata | 162/271 X |
| 5,060,025 | 10/1991 | Kummel et al. . | |
| 5,066,984 | 11/1991 | Coombs . | |
| 5,191,379 | 3/1993 | Manzer et al. . | |
| 5,316,539 | 5/1994 | Leemhuis et al. . | |
| 5,539,511 | 7/1996 | Wenthe, Jr. et al. . | |
| 6,002,913 | 12/1999 | Pawlik et al. | 399/406 |

FOREIGN PATENT DOCUMENTS

| | | |
|---|---|---|
| 60-97163 | 5/1985 | Japan . |

*Primary Examiner*—Sophia S. Chen
*Attorney, Agent, or Firm*—John A. Brady

[57] ABSTRACT

An apparatus for straightening material includes a first guide surface and a second guide surface opposite the first guide surface. Pin (20) for pivoting the second guide surface is included, this operating to pivot the second guide surface toward the first guide surface and away from the first guide surface. A spring (22) for biasing the second guide surface toward the first guide surface is also included, with a variable rate characteristic resulting from contact of the spring with a post (34). The variable rate characteristic allows the second guide surface to pivot away from the first guide surface in proportion to a rigidity of the material to be straightened. Material of varying rigidities is passed between the first guide surface and the second guide surface and the apparatus straightens the material for subsequent processing.

13 Claims, 5 Drawing Sheets

APPARATUS FOR CURLING MATERIALS

RELATED APPLICATION

This is a continuation-in-part of U.S. application Ser. No. 09/393,570 filed Sep. 10, 1999, which will be abandoned in favor of this application.

FIELD OF THE INVENTION

This invention relates to printers and, more particularly, to an apparatus for curling materials, such as paper, used in such printers.

DESCRIPTION OF THE RELATED ART

Many materials, such as paper, become curled after bending and/or heating. Paper may also become curled after one side of the paper undergoes a printing process. Electrophotographic imaging (i.e., laser printing) typically involves bonding toner to a sheet of paper using heat. This application of heat often results in significant curling of the paper. This curling can cause problems in subsequent processing, such as wrinkled paper and paper jams in a laser printer.

This curling problem is reduced by straightening the paper. The paper is straightened by actually curling the paper in an opposite direction. If, for example, the paper curls toward a printed side of the page, the paper can be straightened by curling the paper toward the blank side. Thus the paper is straightened by actually curling the paper.

This concept, of curling paper to straighten paper, is used in laser printers. After the laser printer heats the toner and bonds an image to the paper, the high heat, as mentioned above, can cause the paper to curl. Laser printers use a curling operation to straighten the paper and to reduce the problems associated with the high heat of the fusing process.

Previous curling operations have been effective for only a narrow range of paper weights. For example, these previous curling operations could not be reliably defined for lightweight, medium weight, and heavy weight papers. Typically these previous curling operations could be designed for only a small range of paper weights, and any curling of paper weights lying outside this small range was randomly effective.

U.S. Pat. No. 5,316,539 to Leemhuis et al., issued May 31, 1994, is an example of these previous curling operations. The apparatus disclosed in this patent is constrained by the use of heavy weight paper. Because heavy weight paper often requires little curling, heavy weight paper defines the maximum amount of curling that the apparatus can apply. The curling operation disclosed in this patent linearly operates from this point of maximum curl. A linear curling operation cannot reliably curl paper weights lying outside this narrow linear range.

There is, accordingly, a need in the art for an apparatus which curls a greater range of paper and is predictable and definable for this greater range of paper weight.

SUMMARY OF THE INVENTION

The aforementioned problems are resolved by an apparatus for curling material as described herein. The apparatus includes a first guide surface and a second guide surface opposite the first guide surface. Means for pivoting the second guide surface is included, with the means for pivoting operating to pivot the second guide surface toward the first guide surface and away from the first guide surface. Means for biasing the second guide surface toward the first guide surface is also included, with the means for biasing having a variable or discontinuous rate characteristic. The variable rate characteristic allows the second guide surface to pivot away from the first guide surface in proportion to the rigidity of the material to be straightened. Materials of varying rigidities are passed between the first guide surface and the second guide surface and the apparatus curls the material for subsequent processing.

An apparatus for curling paper is also disclosed. The apparatus includes a decurl roller and a decurl guide opposite the decurl roller. The decurl guide is mounted on a pin and pivots about the pin. A spring includes a first end attached to the decurl guide and a second end attached to a stationary point of the apparatus. At least one limiting feature is positioned such that as the decurl guide pivots away from the decurl roller, a coil of the spring contacts the limiting feature(s) to produce a variable rate characteristic of the spring. This variable rate characteristic allows the second guide surface to pivot away from the first guide surface in proportion to the rigidity of the paper to be curled. The paper is passed between the decurl roller and the decurl guide and the apparatus curls the paper for subsequent processing.

BRIEF DESCRIPTION OF THE DRAWINGS

These and other features, aspects, and advantages of the present invention will be better understood when the following Detailed Description is read with reference to the accompanying drawings wherein.

DETAILED DESCRIPTION

Figure 1:
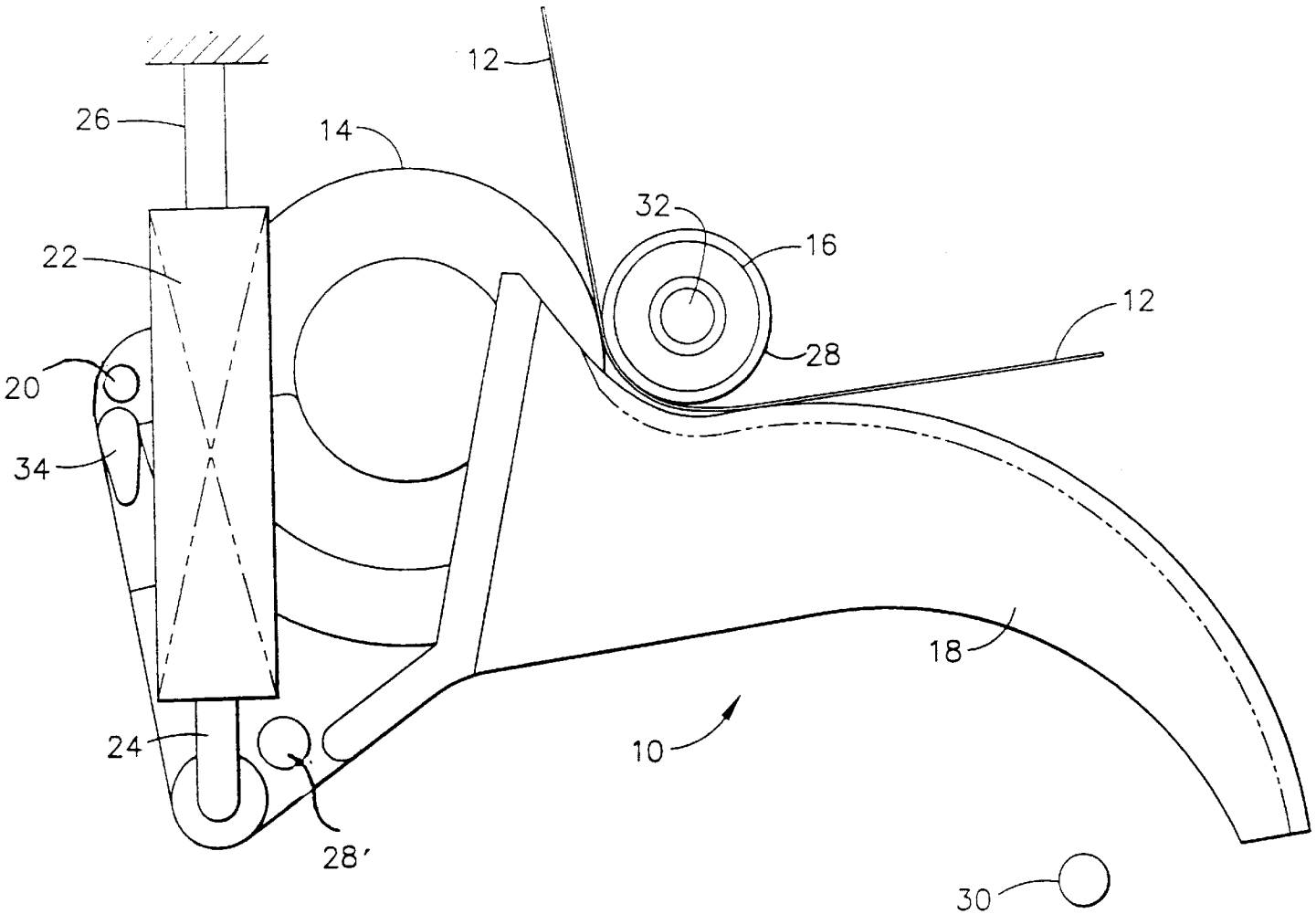
FIG. 1 is a perspective side view of an apparatus for curling paper according to one embodiment of the present invention.

FIG. 1 is a perspective side view of an apparatus 10 for curling paper according to one embodiment of the present invention. Paper 12 is fed between a drive roller 14 and a decurl roller 16. The drive roller feeds the paper into a decurl guide 18 positioned opposite the decurl roller 16. Means for pivoting the decurl guide is included, as the decurl guide 18 is shown mounted on a pin 20 and pivoting about the pin 20. Means for biasing the decurl guide 18 toward the decurl roller 16 is also included, with FIG. 1 showing a spring 22 biasing the decurl guide. A lower first end 24 of the spring is attached to the decurl guide 18. An upper second end 26 of the spring 22 is attached to a stationary point of the apparatus. As paper 12 contacts the decurl guide (as will be discussed and shown with reference to FIG. 2), the decurl guide pivots about the pin 20 and biases spring 22. A first stop 28 or, alternately 28', limits counterclockwise rotation of the decurl guide, and a second stop 30 limits clockwise rotation of the decurl guide. The first stop 28 is the outer surface of a low-friction bushing for a shaft 32. The shaft 32 supports the decurl roller 16. Alternate first stop 28' is a pin located to control lower end 24 of spring 22. The second stop 30 is a pin which contacts the decurl guide 18.

The apparatus further includes at least one limiting feature, such as a post 34 extending from the apparatus. As the decurl guide 18 pivots in a clockwise direction, an effective moment arm of the decurl guide changes. The decurl guide has an initial torsional spring rate prior to contacting the at least one limiting feature 34. This torsional spring rate is a function of both the linear spring rate of the spring 22 and the effective moment arm of the decurl guide 18. The effective moment arm is determined by the mounting location of the spring 22 and the rotational position of the decurl guide around pin 20. Once the decurl guide contacts the at least one limiting feature 34, the number of active coils in the spring is reduced and the effective moment arm around pin 20 of the decurl guide changes. This contact with the at least one limiting feature produces a new and lower torsional spring rate.

The decurl guide 18 and the decurl roller 16 cooperate to curl and to straighten the paper. The decurl roller 16 creates a first guide surface, and the decurl guide 18 creates an opposite second guide surface. A means for driving the material, such as drive roller 14, drives the material between the first guide surface and the second guide surface. The means for biasing operates to bias the second guide surface toward the first guide surface. The limiting feature further alters a variable rate characteristic of the means for biasing. The variable rate characteristic allows the second guide surface to pivot away from the first guide surface in proportion to a rigidity of the material to be straightened. Materials of varying rigidities are passed between the first guide surface and the second guide surface and the apparatus straightens the materials for subsequent processing.

The preferred embodiment of the apparatus has the following characteristics. The drive roller 14 has a diameter of approximately twenty millimeters (20 mm) and is constructed of rubber. Because the drive roller 14 is driven, the rubber material provides a sufficient coefficient of friction to drive the material through the apparatus. Although many other polymer materials are suitable, such as polyurethane and polyesters, any alternative material should preferably be non-marking to white paper. The decurl roller 16 has a diameter of approximately nine millimeters (9 mm) and is constructed of steel, although those skilled in the art will recognize polymer materials are also suitable. The decurl guide is molded of a polycarbonate plastic, however, many other polymer materials are, again, suitable. Although many alternative materials are suitable for the drive roller, the decurl roller, and the decurl guide, the materials of the preferred embodiment are economical.

Figure 2A:
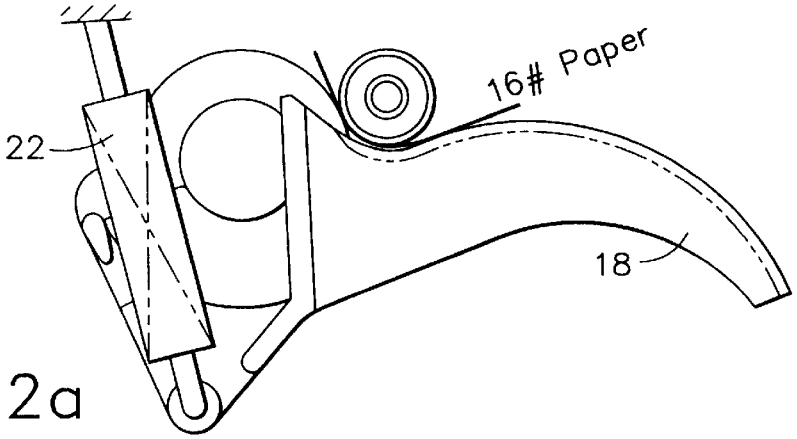
FIGS. 2*a* through 2*c* are a series of perspective side views of the apparatus curling various weight papers.
Figure 2B:
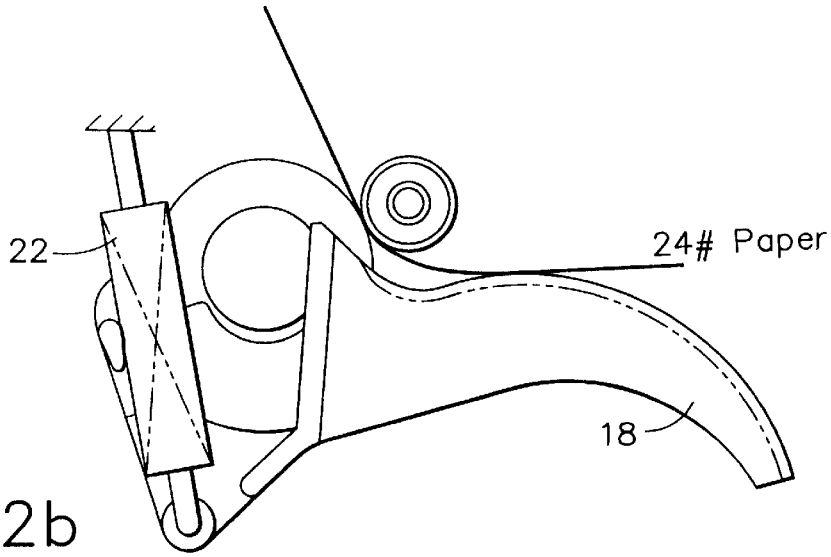
Figure 2C:
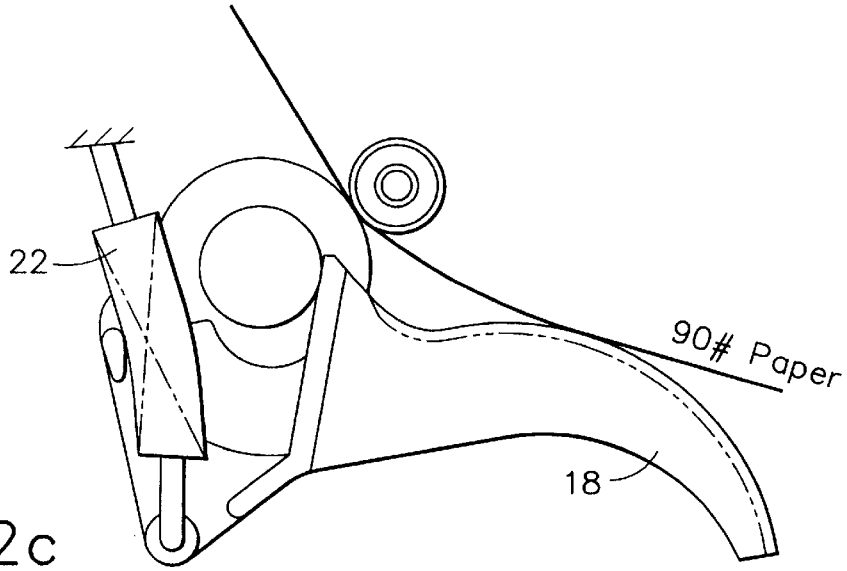

FIG. 2 is a series of perspective side views of the apparatus for curling material. FIG. 2*a* shows the apparatus curling light weight 16# (international measure 60 g/m2) paper. These lightweight papers lack rigidity to pivot the decurl guide 18 and bias the spring 22. FIG. 2*b* shows the apparatus curling medium weight 24# (international measure 90 g/m2) paper. This medium weight paper has enough rigidity to pivot the decurl guide 18 approximately seven degrees (7°) clockwise. FIG. 2*c* shows the decurl guide 18 fully pivoted due to the rigidity of heavy weight 90# index card stock (international measure 163 g/m2) paper. The apparatus thus self-adjusts to the rigidity of the paper and provides the required curling for a wide range of paper weights.

Figure 3:
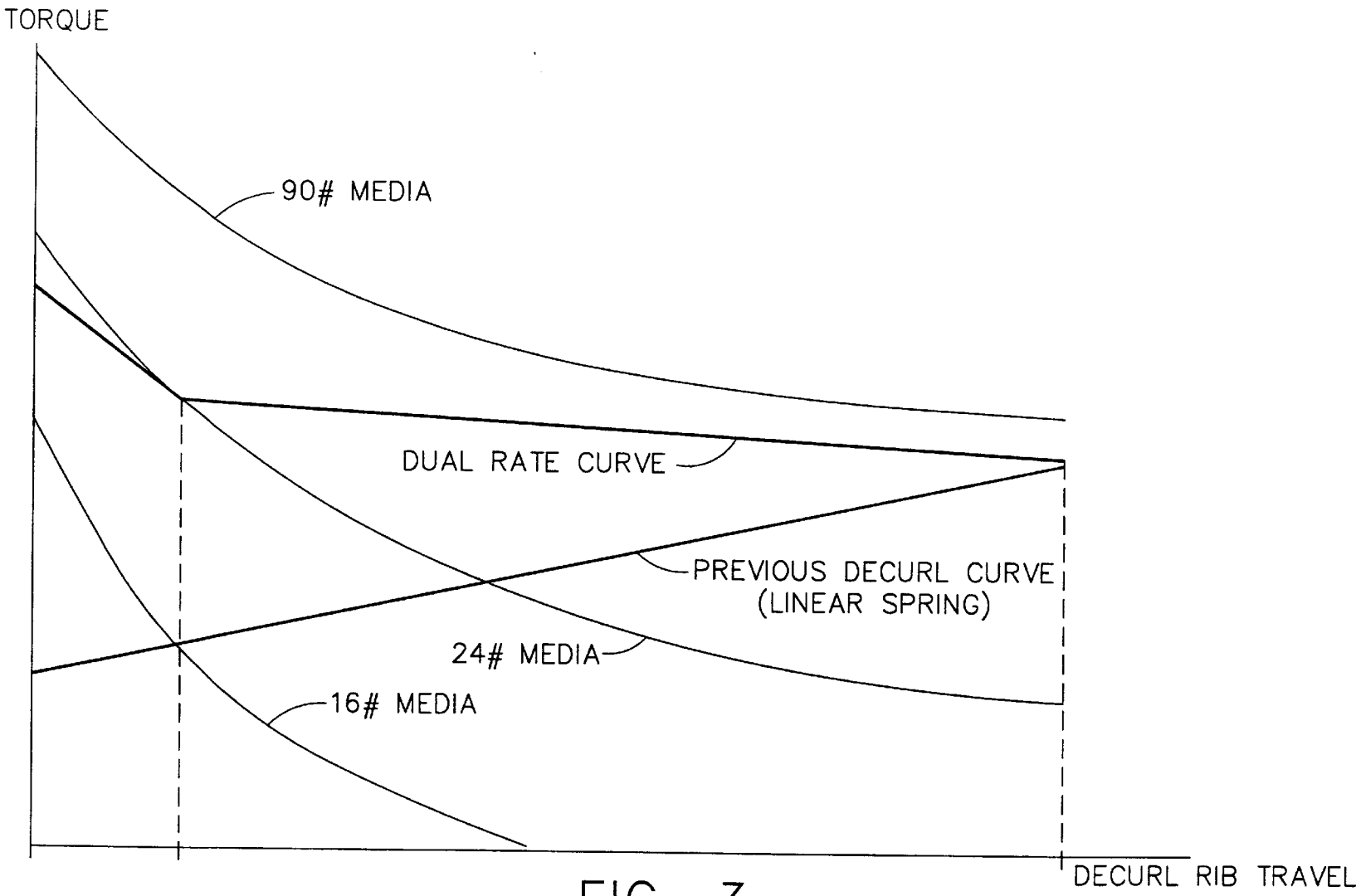
FIG. 3 is a graph showing the torque required to displace a decurl guide using previous linear spring designs and using a variable rate spring of the present invention.

FIG. 3 is a graph showing in heavy lines the torque required to displace the decurl guide using previous linear spring designs and the variable rate present invention. The vertical dashed line shows the point at which spring 22 engages post 34. In this dual rate embodiment the heaviest torque is required to begin movement of guide 18. The light lines show torque which can be delivered by three different media. The 16# media cannot move guide 18. The 24# media opens guide 18 partially. The 90# media provides a torque past the vertical dotted line.

Previous designs using a linear spring could only be defined at two operating points—i) at full decurl guide rotation the maximum torque for paper of 90# (international measure 338 g/m2) was not exceeded, and ii) the desired operating torque for paper of 24# (international measure 90 g/m2) was not violated. The torque required to keep the decurl guide in a zero travel position for lighter weight paper, such as 16# (international measure 60 g/m2), is greater than the torque provided by the previous linear spring designs. Hence, the minimum allowable torque for lightweight paper at a zero, fully closed position is too large for a linear spring design to accommodate.

As FIG. 3 shows, however, this variable rate feature allows the apparatus to curl a greater range of paper weights than these previous designs. The variable rate design of the present invention creates at least three distinct operating conditions. The variable rate design allows the decurl guide 18 to remain in a zero travel position for light weight 16# (60 g/m2) paper. Although the decurl guide is in this zero travel position, or customarily termed the "closed" position, the decurl guide is spaced from the decurl roller a distance greater than a thickness of any paper to be curled by the apparatus. This spacing between the decurl guide and the decurl roller is nominally one millimeter (1 mm). As the decurl guide rotates in the clockwise direction, the decurl guide becomes "slightly open" for 24# (90 g/m2) paper and is "fully open" for 90# (338 g/m2) paper.

Figure 4:
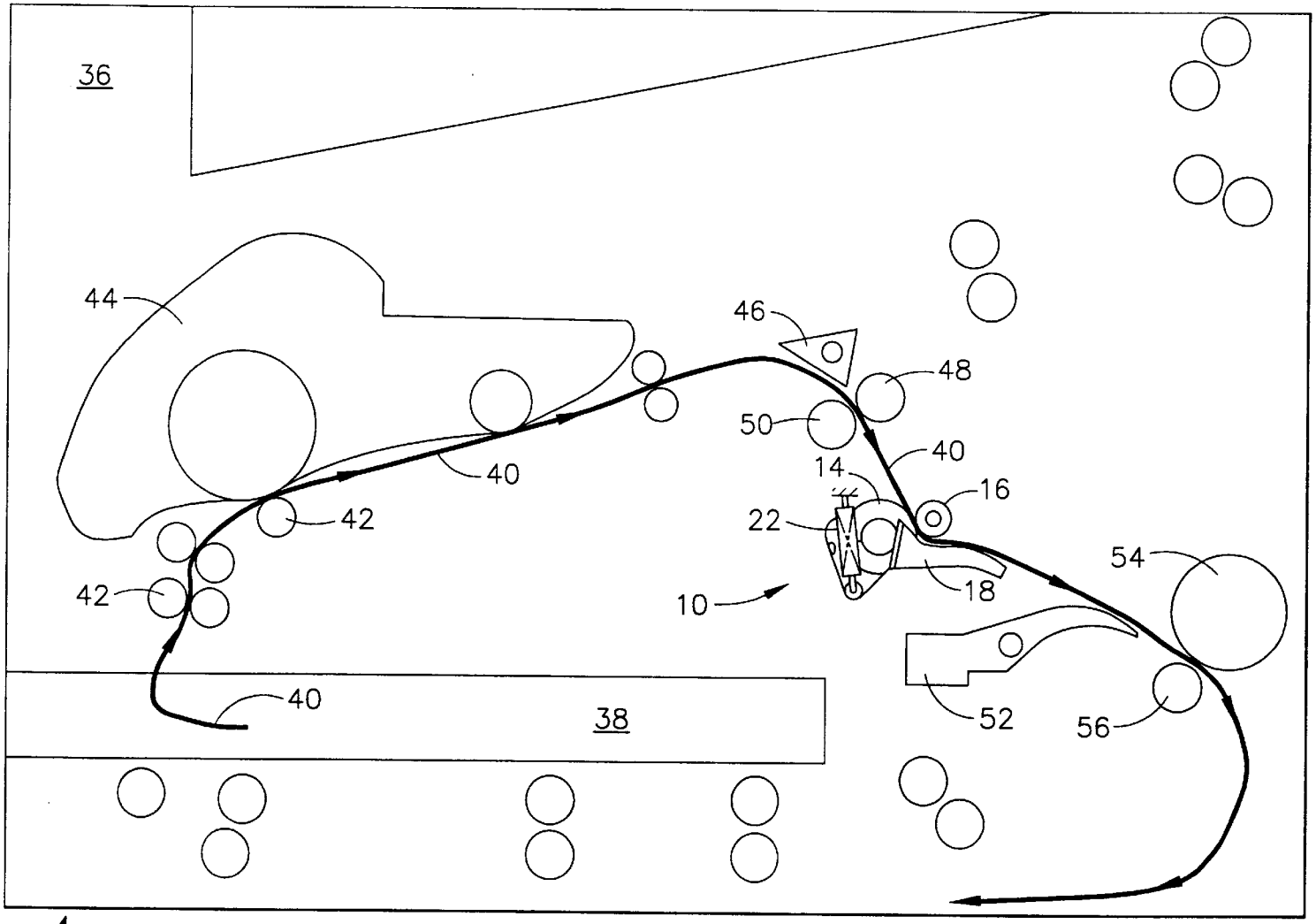
FIGS. 4 and 5 show the apparatus of FIG. 1 operating in an electrophotographic printer.
Figure 5:
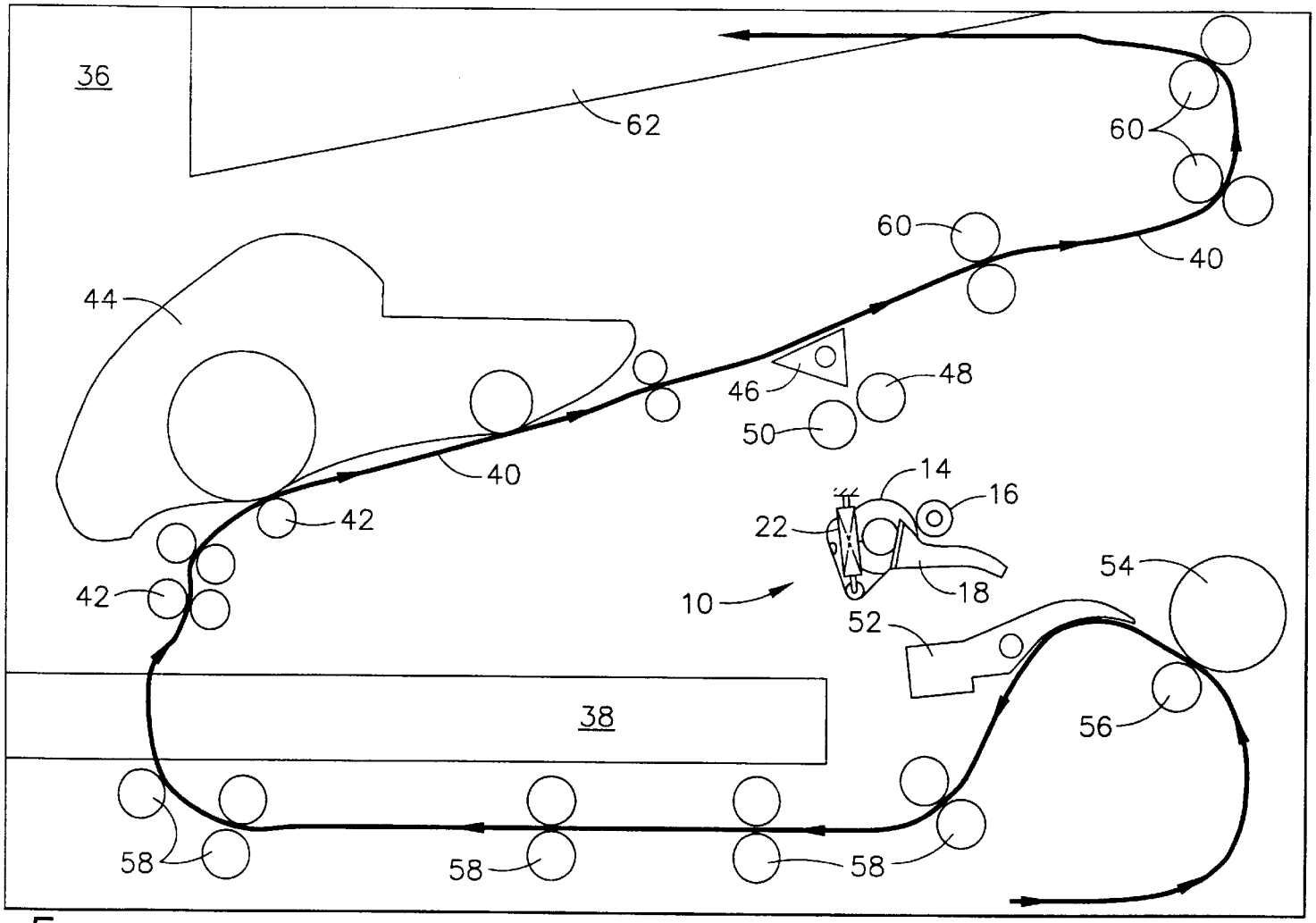

FIGS. 4 and 5 show the apparatus of FIG. 1 operating in an electrophotographic printer, such as that manufactured by LEXMARK™ of Lexington, Ky. The apparatus 10 is shown enlarged for clarity. As FIG. 4 shows, the printer 36 includes a paper supply 38 containing at least one sheet of paper 40. The paper supply is typically a cassette tray contained within the printer. An input system 42 feeds the paper to a print engine 44. The print engine is responsible for writing, transferring, and fusing an image on the paper as is conventionally known in the art. The heat of the print engine causes the paper to curl, so the paper is fed into the apparatus for curling paper 10.

The apparatus for curling paper 10 is positioned within a duplexing paper path. This duplexing paper path is chosen when the paper is to be printed on each side. A first diverter gate 46 directs the paper from the print engine 44 and into the apparatus 10. The sheet of paper 40 is fed between pinch rollers 48 and 50. The pinch rollers 48 and 50 feed the paper into the drive roller 14 and the decurl roller 16. The at least one limiting feature creates the variable rate spring 22. The decurl guide 18 thus self-adjusts to the rigidity of the paper and provides the required curling for a wide range of paper weights. As the paper 40 exits the decurl guide 18, the paper contacts a second diverter gate 52. This second diverter gate directs the paper into a drive roller 54 and into an idler roller 56. The rollers 54 and 56 drive the paper until the paper clears the second diverter gate 52. When the paper clears the second diverter gate, the rollers 54 and 56 stop driving the paper and gravity flips the second diverter gate upward.

FIG. 5 shows the duplexing path once the paper clears the second diverter gate. When the second diverter gate 52 flips upward, the rollers 54 and 56 reverse direction. The rollers 54 and 56 now drive the paper into the second diverter gate 52. The diverter gate directs the paper into a system of duplexer rollers 58. These duplexer rollers 58 direct the paper back into the input system 42. The input system delivers the paper 40, with an unprinted side now facing upward, into the print engine 44. The paper now has an image fused onto each side of the paper, and the paper is once again directed into the first diverter gate 46. Because duplexing is no longer required, the first diverter gate 46 directs the paper into an output system 60. The curled, straightened sheet of paper is then delivered to an output tray 62.

Although the decurl guide is shown as having an arcuate surface, those skilled in the art will recognize that the surface characteristics of the decurl guide may be other shapes to accommodate subsequent processing of the paper.

While the apparatus is described for use in curling paper, those skilled in the art will recognize the apparatus (or variations of the apparatus) may also be used to curl non-paper materials such as wood pulps and wood fibers, silks, and cottons.

Although the apparatus is shown having only one limiting post, those skilled in the art will recognize that more than one limiting post may used. For example, two limiting posts could be designed to progressively contact the spring and create a three rate design. Similarly, multiple limiting posts could be designed to progressively contact the spring and create multiple rate operating conditions.

While a coil spring is disclosed, those skilled in the art will recognize other types of biasing elements could be used. A leaf spring could, for example, be cantilevered from a stationary point on the apparatus. As the decurl guide pivots, a contact point between the guide and the spring could move along the spring. As the contact point moves towards the stationary point on the apparatus, the cantilevered spring rate increases and produces a similar result as discussed above.

Furthermore, those skilled in the art will recognize alternative features could be used to create a variable rate coil spring.

While the present invention has been described with respect to various features, aspects, and embodiments, those skilled and unskilled in the art will recognize the invention is not so limited. Other variations, modifications, and alternative embodiments may be made without departing from the spirit and scope of the present invention.

What is claimed is:

1. An apparatus for straightening material, the apparatus comprising:

a first guide surface;

a second guide surface opposite the first guide surface;

means for pivoting the second guide surface toward the first guide surface and away from the first guide surface;

means for biasing the second guide surface toward the first guide surface, the means for biasing having a discontinuous rate characteristic, the discontinuous rate characteristic allowing the second guide surface to pivot away from the first guide surface in proportion to a rigidity of the material to be straightened;

wherein when the material is passed between the first guide surface and the second guide surface, the apparatus straightens the material for subsequent processing.

2. An apparatus for straightening material according to claim 1, wherein the means for biasing the second guide surface includes a coil spring, the coil spring having a first end attached to the means for pivoting the second guide surface, and the coil spring having a second end attached to a stationary point of the apparatus.

3. An apparatus for straightening material according to claim 2, the means for biasing the second guide surface further including at least one limiting feature, the at least one limiting feature designed to contact at least one coil of the spring at a predetermined rigidity of the material, the contact between the at least one limiting feature and the at least one coil producing the discontinuous rate characteristic.

4. An apparatus for straightening material according to claim 1, further comprising means for driving the material between the first guide surface and the second guide surface.

5. An apparatus for straightening material according to claim 1, wherein the first guide surface is spaced from the second guide surface a distance greater than a thickness of the material to be straightened.

6. An apparatus for straightening material according to claim 1, further comprising a first stop to limit counterclockwise rotation of the second guide surface.

7. An apparatus for straightening material according to claim 6, further comprising a second stop to limit clockwise rotation of the second guide surface.

8. An apparatus for straightening paper, the apparatus comprising:

a decurl roller;

a decurl guide opposite the decurl roller, the decurl guide mounted on a pin and pivoting about the pin;

a spring having a first and a second end, the first end attached to the decurl guide and the second end attached to a stationary point of the apparatus; and at least one limiting feature positioned such that as the decurl guide pivots away from the decurl roller, a coil of the spring contacts the at least one limiting feature to produce a discontinuous rate characteristic of the spring, the discontinuous rate characteristic allowing the decurl guide to pivot away from the decurl roller in proportion to a rigidity of the paper to be straightened;

wherein when the paper is passed between the decurl roller and the decurl guide, the apparatus straightens the paper for subsequent processing.

9. An apparatus for straightening paper according to claim 8, further comprising means for driving the paper between the decurl roller and the decurl guide.

10. An apparatus for straightening paper according to claim 8, wherein the decurl roller is spaced from the decurl guide a distance greater than a thickness of the paper to be straightened.

11. An apparatus for straightening paper according to claim 8, further comprising a first stop to limit counterclockwise rotation of the decurl guide.

12. An apparatus for straightening paper according to claim 11, further comprising a second stop to limit clockwise rotation of the decurl guide.

13. An electrophotographic printer for printing an image on a sheet of paper, the printer comprising:

an input system;

a print engine for producing the image on the sheet of paper, the input system delivering the sheet of paper to the print engine;

an apparatus for straightening the sheet of paper, the apparatus receiving the sheet of paper from the print engine, the apparatus including a decurl roller, a decurl guide, and a spring, the decurl guide mounted on a pin opposite the decurl roller and pivoting about the pin, the spring having a first end attached to the decurl guide and a second end attached to a stationary point of the apparatus, the apparatus having at least one limiting feature positioned such that as the decurl guide pivots away from the decurl roller, a coil of the spring contacts the at least one limiting feature to produce a discontinuous rate characteristic of the spring, the discontinuous rate characteristic allowing the decurl guide to pivot away from the decurl roller in proportion to a rigidity of the paper;

wherein when the sheet of paper passes between the decurl roller and the decurl guide, the apparatus for straightening the sheet of paper decurls the paper.

* * * * *